United States Patent [19]

Watanabe et al.

[11] Patent Number: 5,018,501

[45] Date of Patent: May 28, 1991

[54] ELECTROMAGNETIC FUEL INJECTION VALVE APPARATUS

[75] Inventors: Haruo Watanabe, Ibaraki; Ichiro Nakamura, Katsuta; Yoshio Okamoto, Ibaraki; Hitoshi Konno, Katsuta, all of Japan

[73] Assignee: Hitachi, Ltd., Tokyo, Japan

[21] Appl. No.: 458,293

[22] Filed: Dec. 28, 1989

[30] Foreign Application Priority Data

Dec. 28, 1988 [JP] Japan ..... 63-334036

[51] Int. Cl.[5] ..... F02M 15/00

[52] U.S. Cl. ..... 123/472; 123/434; 239/463

[58] Field of Search ..... 123/434, 472, 305, 445, 123/299; 239/461, 463, 464, 468, 472, 585; 137/354; 29/620

[56] References Cited

U.S. PATENT DOCUMENTS

| | | | |
|---|---|---|---|
| 1,239,168 | 9/1917 | Eneas | 239/472 |
| 1,625,635 | 4/1927 | Willners | 239/472 |
| 1,628,424 | 5/1927 | Peabody | 239/472 |
| 2,273,830 | 2/1942 | Brierly et al. | 239/472 |
| 2,921,746 | 1/1960 | Burman | 239/464 |
| 4,274,598 | 6/1981 | Wilfert et al. | 239/585 |
| 4,436,071 | 3/1984 | Hafner et al. | 123/434 |
| 4,565,082 | 6/1986 | Heath et al. | 239/463 |
| 4,883,252 | 11/1989 | Mesenich | 123/472 |
| 4,907,745 | 3/1990 | Messingschlager | 239/463 |

FOREIGN PATENT DOCUMENTS

| | | | |
|---|---|---|---|
| 88/04727 | 6/1988 | United Kingdom | 123/472 |

*Primary Examiner*—Raymond A. Nelli

*Attorney, Agent, or Firm*—Antonelli, Terry, Stout & Kraus

[57] ABSTRACT

A plate valve type electromagnetic fuel injection valve according to the present invention is directed to achieving excellent atomization of fuel. The electromagnetic fuel injection valve is characterized by the provision of a fuel rotating element for causing fuel to flow in a circle. In this way, the fuel is made to flow in a circle, and this accelerates atomization of the fuel.

17 Claims, 11 Drawing Sheets

ELECTROMAGNETIC FUEL INJECTION VALVE APPARATUS

BACKGROUND OF THE INVENTION

1. Field of the Invention

The present invention relates to an electromagnetic fuel injection valve suitable for use in an engine for an automobile or the like, and more particularly, to an electromagnetic fuel injection valve structure which exhibits excellent response and atomization characteristics.

2. Description of the Related Art

Conventional electromagnetic fuel injection valve of the type which includes a disk-shaped movable member as a valve body have been proposed in the specification of, for example, International Publication No. WO 88/04727. This electromagnetic fuel injection valve uses a lightweight movable portion and therefore exhibits quick response. In this fuel injection valve, a valve seat, which is disposed opposite the valve body, has only an injection hole formed therein. Hence, motion only in an axial direction is imparted to the fuel while it is passing through the injection hole.

Thus, in the above-described conventional device, although the movable portion is lightweight and quick response can therefore be achieved, no consideration is given to the control of the atomization of the fuel and of the form into which the fuel is atomized, raising problems concerning the response and the ease with which an engine can be started at a low temperature. More specifically, fuel which is under a pressure (2 to 4 $kgf/cm^2$) normally employed in a gasoline engine is atomized such that it has an average particle diameter of 300 $\mu m$ or above. This means the atomized fuel is seen not as a spray but as a shower. Furthermore, the spray is not diffused and has only a bar-like shape. Furthermore, a deposit is readily formed on the injection hole when a substitute for gasoline is used.

In order to allow an electromagnetic fuel injection valve to be employed in various types of engines, there has been a demand for an electromagnetic fuel injection valve which exhibits excellent fuel atomization and which enables the form into which the fuel is sprayed to be selected flexibly.

SUMMARY OF THE INVENTION

An object of the present invention is to provide an electromagnetic fuel injection valve which employs a disk-shaped movable member as a valve body, ensures improved fuel atomization and enables the form of spray to be selected in accordance with the type of engine.

To this end, the present invention provides an electromagnetic fuel injection valve which includes an injection hole through which fuel is injected, and a plate valve member provided upstream of the injection hole for controlling an amount of fuel to be injected and further includes a fuel rotating element for causing the fuel to flow in a circle.

In this electromagnetic fuel injection valve, the fuel supplied is made to flow in a circle by the fuel rotating element. Since the fuel rotating element and the injection hole communicate with each other, the fuel to which rotational force is applied by the fuel rotating element is introduced to the injection hole, through which it is injected. At that time, atomization of the fuel is accelerated due to the rotational force applied thereto.

DESCRIPTION OF THE PREFERRED EMBODIMENTS

Figure 2:
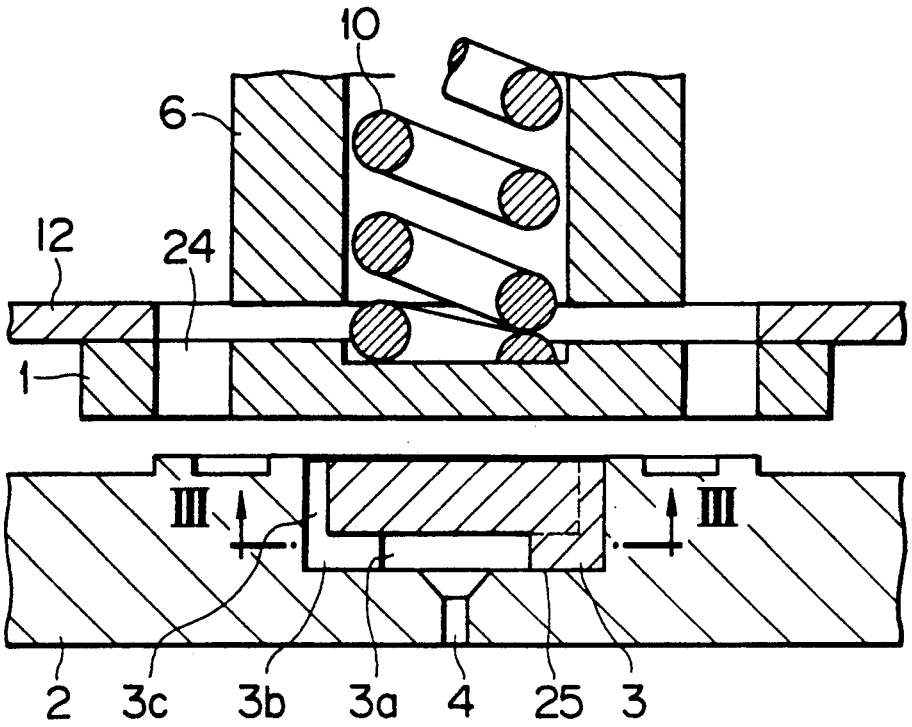
FIG. 2 is an enlarged view of the essential parts of the fuel injection valve of FIG. 1.
Figure 3:
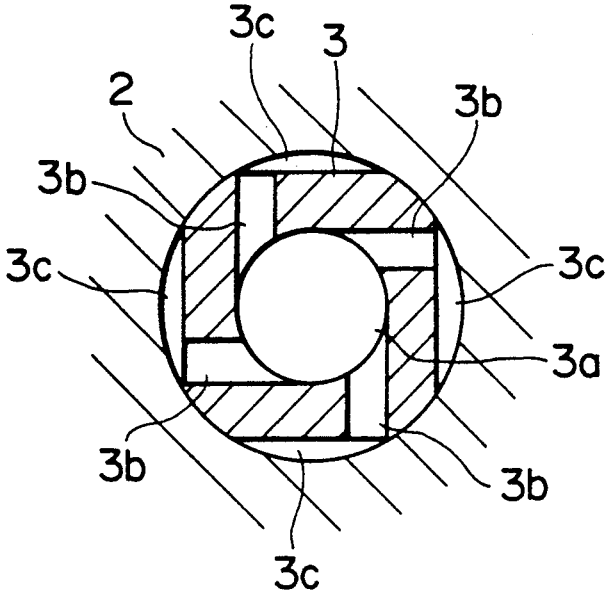
FIG. 3 is a section taken along the line III—III and viewed in the direction indicated by the arrows.

A first embodiment of the present invention will be described below with reference to FIGS. 1 to 3.

Figure 1:
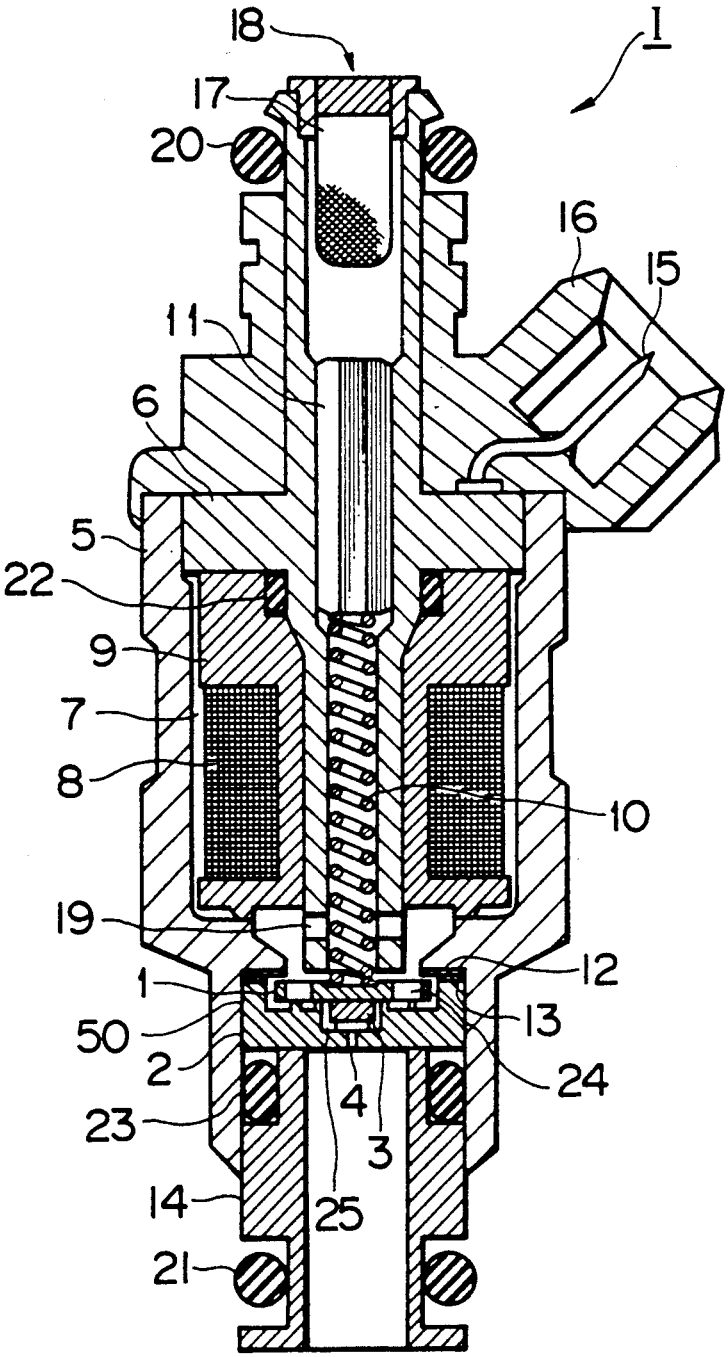
FIG. 1 is a vertical cross-sectional view of a fuel injection valve, showing a first embodiment of the present invention.

Referring first to FIG. 1, a fuel injection valve includes a driving source consisting of a magnetic circuit and a coil assembly 7 for exciting the magnetic circuit, a plate valve 1 which is a disk-like movable member raised a predetermined distance by the excitation of the magnetic circuit, a valve seat 2 which is disposed opposite the plate valve 1, the valve seat 2 and the plate valve 1 in combination forming a variable restriction mechanism and a plate valve member 50, a fuel rotating element 3 for causing the fuel introduced into the valve seat 2 to flow in a circle, an injection hole 4 which forms a fixed restriction mechanism, a stopper 12 for limiting the distance through which the plate valve 1 is raised, and a spring 10 for urging the plate valve 1.

The magnetic circuit is formed by a cylindrical yoke 5, a core 6, which is a hollow, columnar plug member extending along the center, and closing the open end, of the yoke 5, and the plate valve 1 which is a movable member disposed opposite the core with a gap therebetween.

The columnar core 6 has a hole along its central axis in which the spring 10, which is an elastic member for urging the plate valve 1 against the valve seat 2, is retained. The upper end of the spring 10 abuts against the lower end of an adjuster 11 inserted into the center of the core 6 for adjusting the set load of the spring 10.

The coil 8 for exciting the magnetic circuit is wound around a bobbin 9. The coil assembly 7, which consists of the coil 8 and the bobbin 9, has a terminal 15 which is surrounded by a resin mold constituting a molded connector 16.

A filter 17 is provided at an inlet 18 for fuel so as to prevent dust or foreign matter contained in the fuel or in the pipe from entering the fuel injection valve apparatus. The fuel, which is introduced through the inlet 18, passes through a gap formed between the core 6 and the adjuster 11 having a polyhedron cross-section, the central hole in the core 6, and then a plurality of holes 19 formed in the core 6, before reaching the plate valve 1.

A nozzle 14 is provided so as to prevent carbon or the like contained in the air of a suction pipe (not shown) of an engine from depositing on the fuel hole 4 when the fuel injection valve is mounted on the suction pipe or the like.

O-rings 20, 21, 22 and 23 are provided in order to prevent fuel leakage.

A spacer 13 is capable of adjusting the distance through which the plate valve 1 is lifted.

The plate valve 1 has a plurality of through-holes 24 in its circumferential direction which form fuel passages.

The structure of the valve seat will be described in detail with reference to FIGS. 2 and 3.

The valve seat 2 has a cylindrical receiving portion 25 for receiving the fuel rotating element 3. The cylindrical receiving portion 25 is formed coaxially with respect to the injection hole 4 and has a larger diameter than the injection hole 4. The cylindrical receiving portion 25 is located immediately in advance of the side of the injection hole 4 from which fuel is introduced into the injection hole 4. The fuel rotating element 3 is fixedly provided in this receiving portion 25. The fuel rotating element 3 has a cylindrical fuel rotating chamber **3*a* which is coaxial with respect to the injection hole 4 and which has a larger diameter than the fuel hole 4, and a plurality of groove-like channels 3*b* (four channels in the embodiment shown in FIG. 3). The channels 3*b* are formed eccentrically and in a tangential direction with respect to the fuel rotating chamber 3*a*, and communicate with the fuel rotating chamber 3*a*. The circumference of the cylindrical fuel rotating element 3 is notched at a plurality of positions (four positions in the embodiment shown in FIG. 3) to form arcuate passages 3*c*. These arcuate passages 3*c* constitute fuel inlets when the fuel rotating element 3 is mounted on the valve seat 2. The area of the fuel inlets 3*c* and of the groove-like channels 3*b* is set to a value which is at least twice the area of the flow channel formed by the plate valve 1 and the valve seat 2 (when the valve is opened), so as to suppress the pressure loss in the plate valve 1. The area of the injection hole 4 is narrowed so that the fuel can be measured by being passed through the injection hole 4. The fuel rotating element 3** is manufactured by sintering.

The operation of the thus-arranged fuel injection valve will be described below.

The fuel injection valve is of the type in which the plate valve 1 is operated by an electrical on/off signal applied to the coil 8 so as to form a flow passage between the plate valve and the valve seat 2, by means of which fuel injection is performed.

Figure 20:
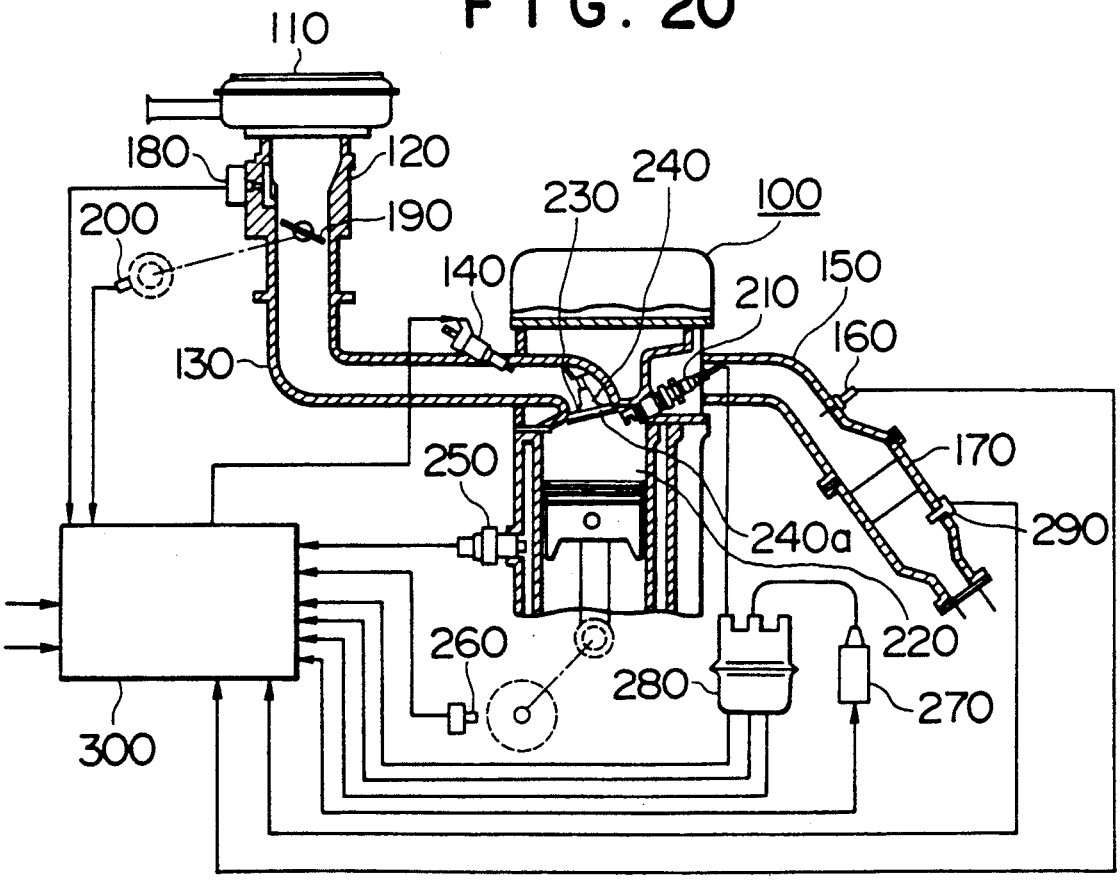
FIG. 20 is a schematic view of an engine control system on which the fuel injection valve according to the present invention is mounted.

The electrical signal is applied to the coil 8 in the form of a pulse, whose width is controlled in accordance with the amount of fuel to be injected by an electronic control device (see FIG. 20). The plate valve 1 is normally pressed against the valve seat 2 by means of the compressive force of the spring 10 and the urging force of a fuel pressure. As a current flows in the coil 8, the core 6, the yoke 5 and the plate valve 1 in combination form a magnetic circuit, generating a force of attracting the plate valve 1. When the attracting force on the plate valve 1 exceeds the urging force of the spring and the fuel pressure, the plate valve 1 is raised and a fuel flow passage is formed between the plate valve 1 and the valve seat 2. The fuel, which is to flow into the valve seat 2 from the plate valve 1, passes through the channels **3*c* and then the channels 3*b* of the fuel rotating element 3 before entering the fuel rotating chamber 3*a*, where it is caused to flow in a circle around the fuel rotating chamber 3*a*. The fuel, to which a rotational force is applied, is then injected through the injection hole 4. Rotational force applied to the fuel accelerates atomization thereof. More specifically, the fuel flows from a fuel gallery, through a socket and the filter 17, and into the fuel injection valve from its fuel inlet 18 under a pressure determined by a fuel pump and a fuel pressure regulator (which are not shown). In the fuel injection valve, the fuel passes through the interior of the core 6, the plurality of holes 19 formed in the core 6, the plurality of holes 24 formed in the plate valve 1, and is then supplied to the opened portion of the valve seat 2 when it is opened. Thereafter, the fuel is introduced into the fuel rotating chamber 3*a* of the fuel rotating element 3, and is then injected into a suction pipe (not shown) of, for example, an engine from the injection hole 4**.

When the coil 8 is deenergized and the attracting force of the plate valve 1 thereby disappears, the plate valve 1 is pressed against the valve seat 2 by the spring 10 and the fuel pressure (compressive force of the spring 10 exceeds the fuel pressure) thereby closing the flow channel formed between the plate valve 1 and the fuel rotating element 3. The flow area of the injection hole 4 is made very small so that the amount of fuel to be injected can be measured by the injection hole 4, which is required to cause the fuel to flow in a circle efficiently. In this embodiment, the fuel which is under a pressure (2 to 4 $kgf/cm^2$) normally employed in a gasoline engine can be atomized such that it has an average diameter of 100 $\mu m$ or less. Furthermore, since the fuel is subjected to a rotational force as it passes through the injection hole, the injection hole can be cleaned, thus eliminating any deposit. Furthermore, the circumferential surface of the cylindrical fuel rotating element is notched at a plurality of positions so that the form of the fuel rotating element can be simplified, thus facilitating the manufacture thereof. Furthermore, since the fuel rotating element is not machine processed but manufactured by sintering, the time required for manufacture can be decreased and the production cost of the product can be thereby reduced.

Figure 4:
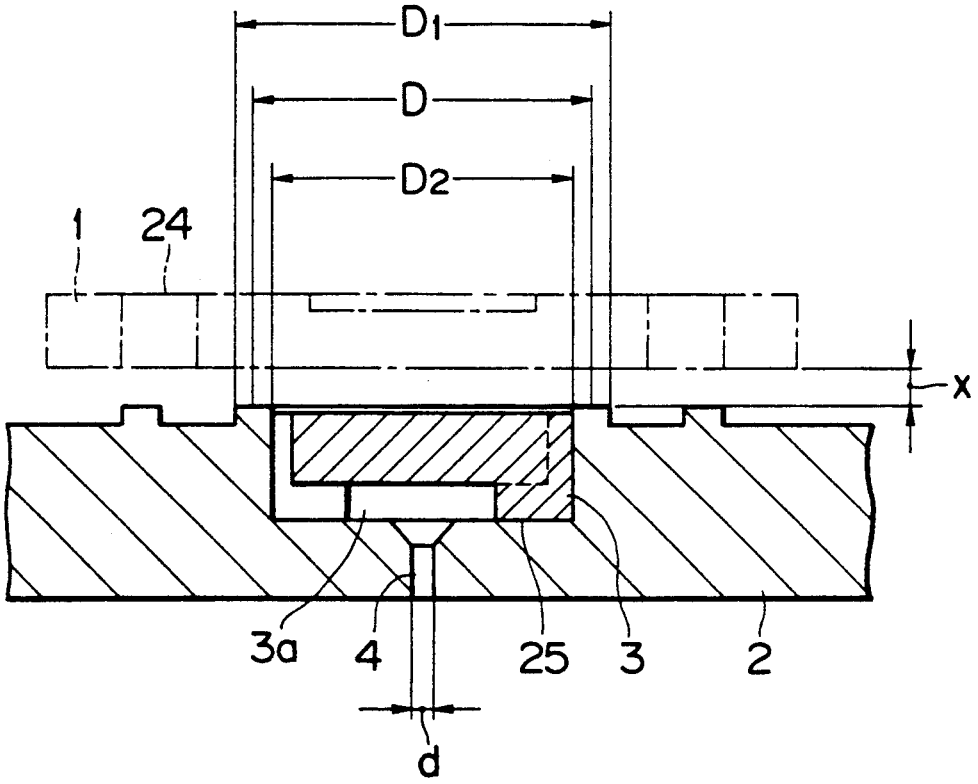
FIG. 4 explains the area of an opening in the fuel injection valve shown in FIG. 2.

The static flow rate of a fuel is affected by the pressure loss in the flow channels in the fuel rotating element 3 and the rotational force applied to the fuel. The pressure loss of the flow channels is mainly determined by the sectional area of the flow channels. The sectional area of the flow channels of this embodiment will be described below with reference to FIG. 4. A sectional area $A_1$ of the flow channels of the fuel rotating element 3 is expressed by the following equation by the hydrodynamic diameter expressed using the width W of the grooves of the fuel rotating element 3 and the depth H of the grooves:

$$A_1 = n\frac{\pi}{4}\left(\frac{2WH}{W+H}\right)^2 \quad (1)$$

where n is the number of grooves.

Next, An area $A_2$ of the opening in the plate valve 1 is expressed as follows:

$$A_2 = \pi D x \quad (2)$$

where D is a typical diameter of a seat, which is $D=(1/2)(D_1+D_2)$, and x is a distance through which the plate valve 1 is raised.

A sectional area $A_3$ of the injection hole 4 is expressed by:

$$A_3 = \frac{\pi}{4}d^2 \quad (3)$$

where d is the diameter of the injection hole 4.

In this embodiment, the sectional area $A_3$ of the injection hole 4 and the areas $A_1$ and $A_2$ have the following relation:

$A_1 > A_2 > A_3$

This means the injection hole 4 is the narrowest flow channel. In other words, the amount of fuel to be injected is measured by the injection hole 4 alone. Furthermore, the velocity of flow of the fuel increases as the fuel flows downstream. In consequence, there is no pressure drop in the supplied fuel, and an efficient stream of fuel can be obtained, which leads to the excellent atomization of fuel.

Next, a second embodiment of the present invention will be described with reference to FIG. 5. In the fuel injection valves according to this second and subsequent embodiments, parts which are the same as those in FIG. 1 are denoted by the same reference numerals. Since the basic structure of the second and subsequent embodiments is the same as that of the first embodiment shown in FIGS. 1 to 3, only the portion which is different will be described.

Figure 5:
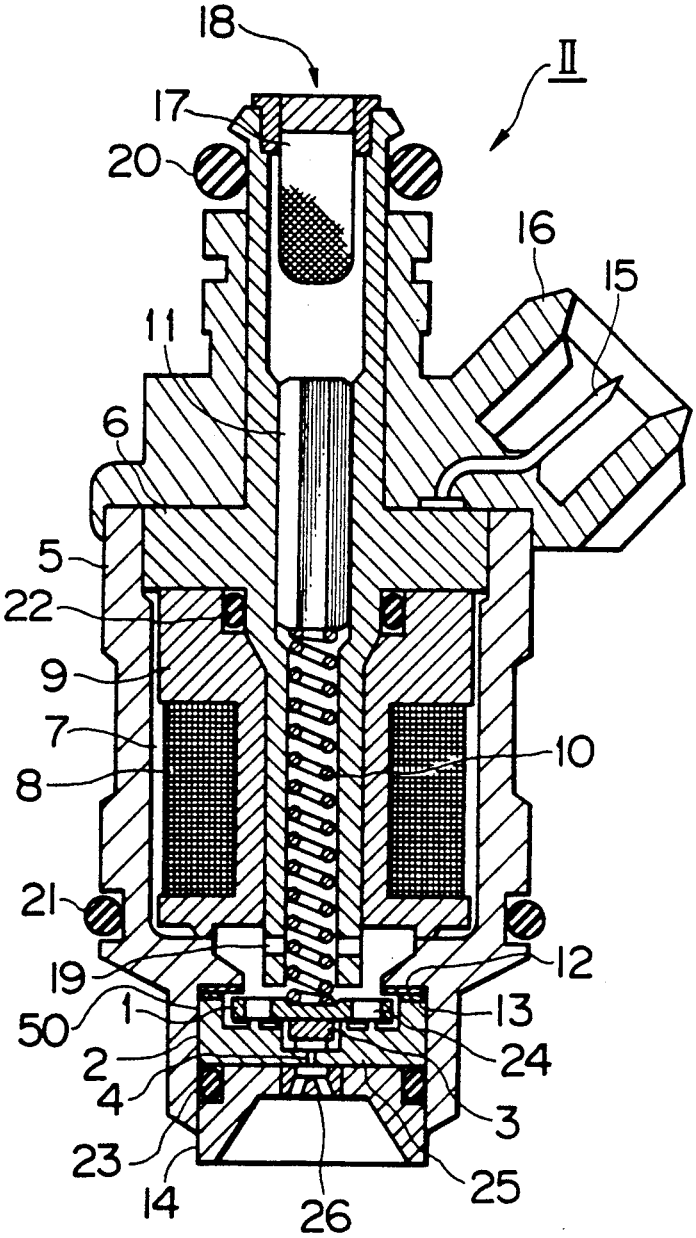
FIG. 5 is a vertical cross-sectional view of a fuel injection valve with an atomized fuel dividing means, showing a second embodiment of the present invention.
Figure 7:
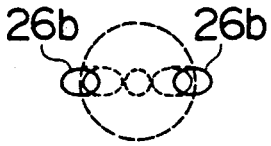
FIG. 7 is a section taken along the line VII—VII of FIG. 6 and viewed in the direction indicated by the arrows.
Figure 8:
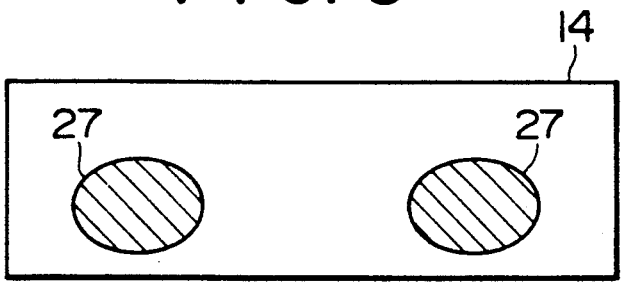
FIG. 8 is a section taken along the line VIII—VIII of FIG. 6.
Figure 6:
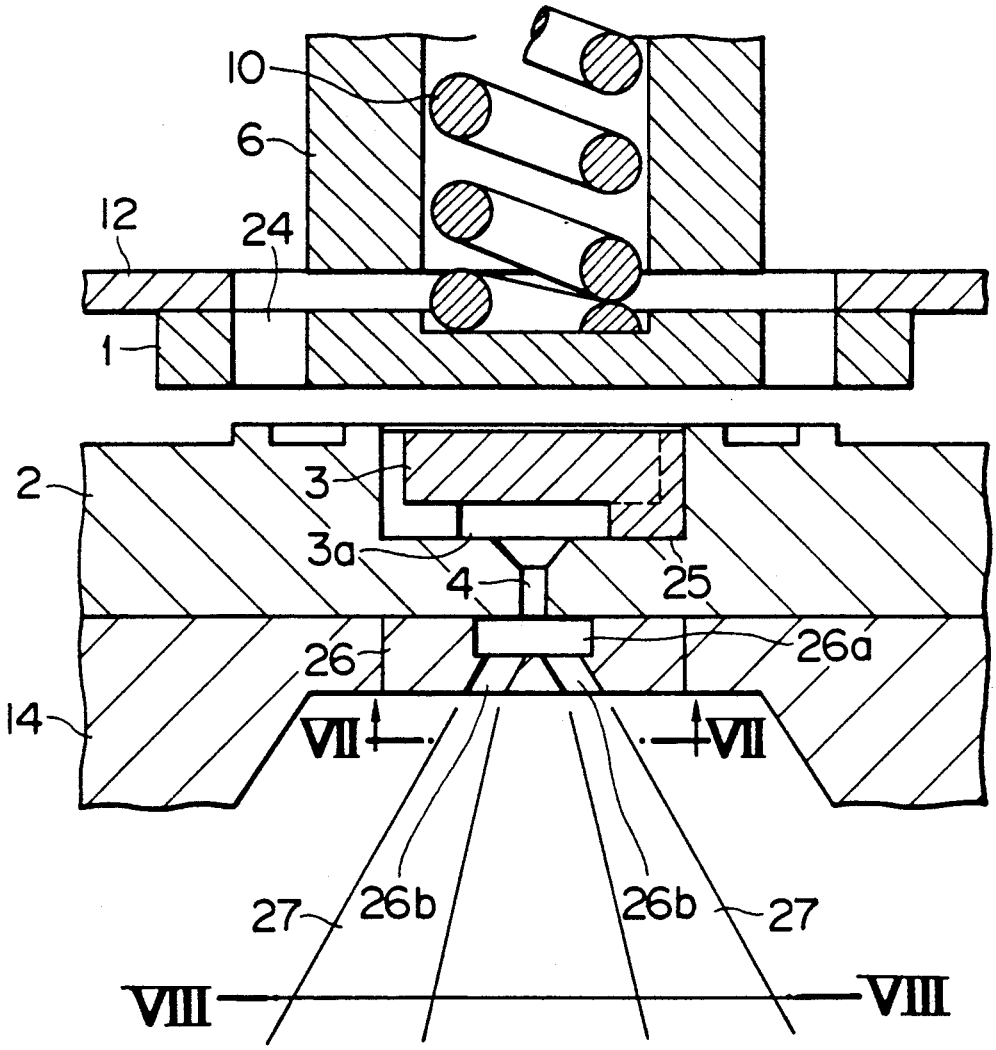
FIG. 6 is an enlarged view of the essential parts of the fuel injection valve of FIG. 5.

In the fuel injection valve shown in FIG. 5, an atomized fuel dividing means 26 is provided downstream of the injection hole 4 formed in the valve seat 2. The atomized fuel dividing means 26 shown in FIG. 5 consists of a second fuel rotating chamber **26*a* which is coaxial with respect to the injection hole 4, and a plurality of (two second injection holes 26*b* in FIG. 6, the number thereof being an arbitrary value) second injection holes 26*b* having a circular cross-section, as shown in FIGS. 6 and 7. If two circular injection holes 26*b* are formed, two separate atomized fuel portions 27 are injected therefrom, as shown in FIG. 8**.

Figure 9:
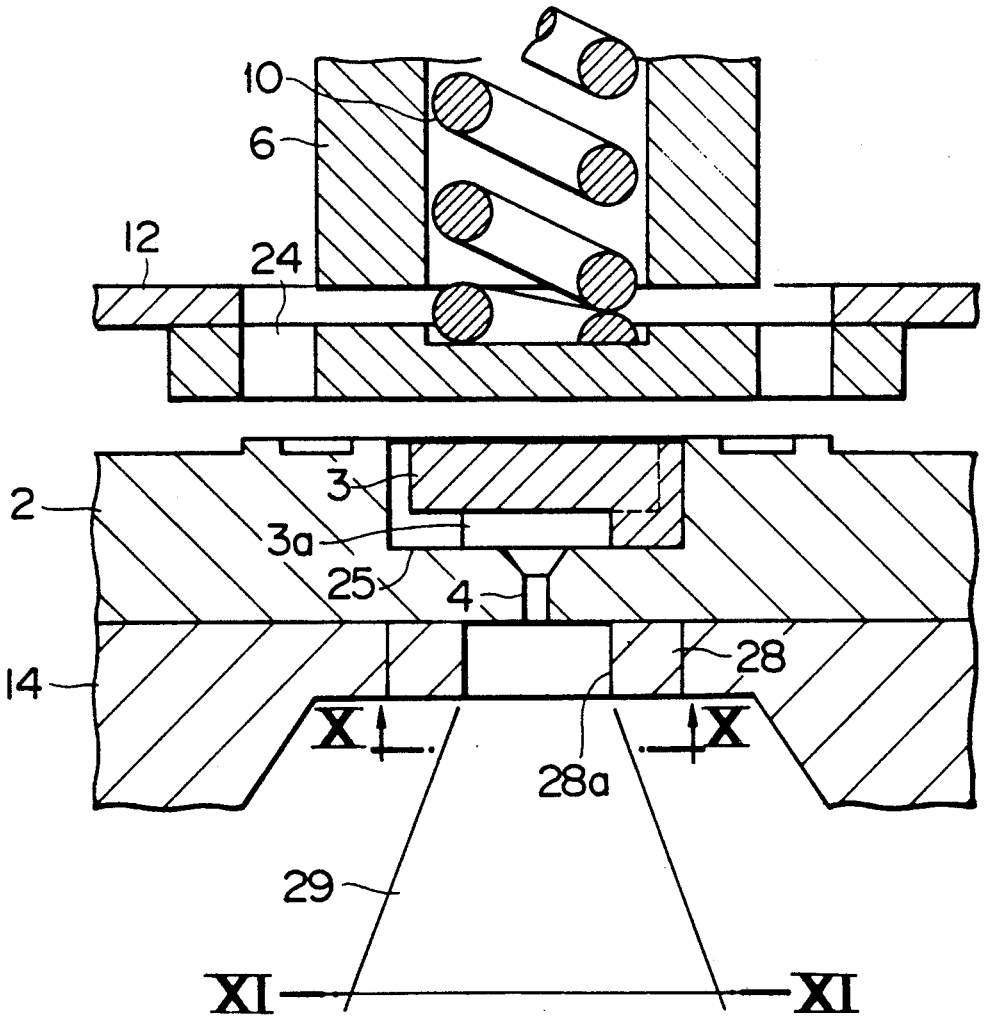
FIG. 9 is a view similar to FIG. 6, showing a third embodiment of the present invention.
Figure 10:
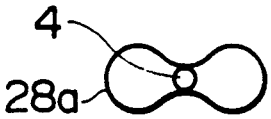
FIG. 10 is a section taken along the line X—X of FIG. 9 and viewed in the direction indicated by the arrows.
Figure 11:
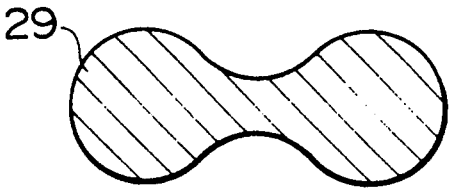
FIG. 11 is a section taken along the line XI—XI of FIG. 9.

FIG. 9 shows the essential parts of a fuel injection valve with another atomized fuel dividing means 28 which replaces the atomized fuel dividing means 26 of FIG. 6. The atomized fuel dividng means shown in FIG. 9 is a simplified type of the atomized fuel dividing means 26, and is constructed such that the second fuel rotating chamber **26*a* and the second injection holes 26*b* are formed as one unit. An injection hole 28*a* of the atomized fuel dividing means 28 has a gourd-like form, as shown in FIG. 10 which is a section taken along the line X—X of FIG. 9 and viewed in the direction indicated by the arrows. An atomized fuel 29 which is injected from the injection hole 28*a* is also divided into two portions, as shown in FIG. 11**. Any desired pattern of atomized fuel can be obtained by adequately selecting the shape of the second injection hole of the atomized fuel dividing means.

In addition to the aforementioned advantages, the fuel injection valve according to this embodiment has an advantage in that it is capable of efficiently supplying atomized fuel to an engine having a plurality of suction valves.

In the above-described embodiments, the fuel inlet is provided at the upper portion of the fuel injection valve. However, the position of the fuel inlet is not limited to this.

Figure 12:
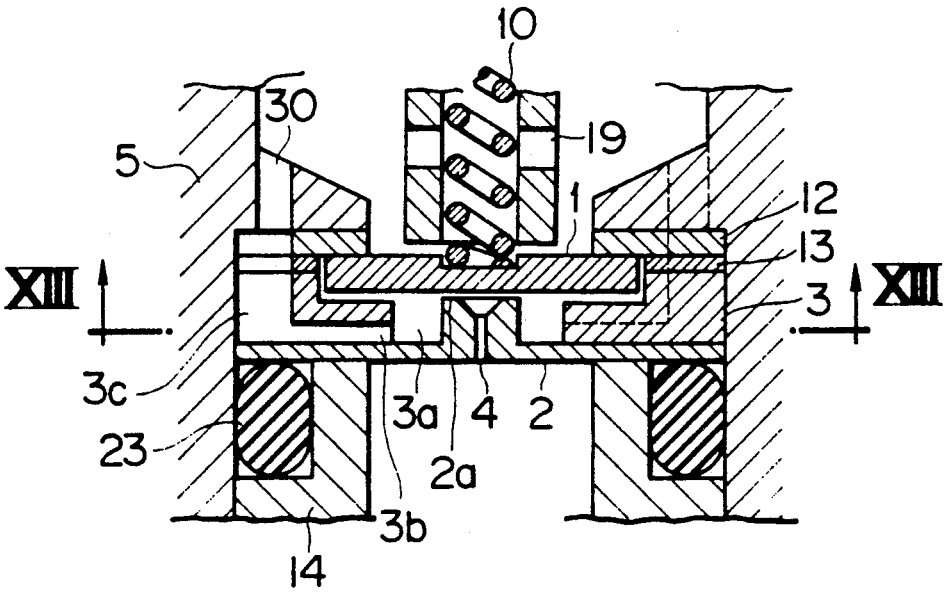
FIG. 12 is an enlarged view of the essential parts of a fuel injection valve in a state where a plate valve is raised, showing a fourth embodiment of the present invention.
Figure 13:
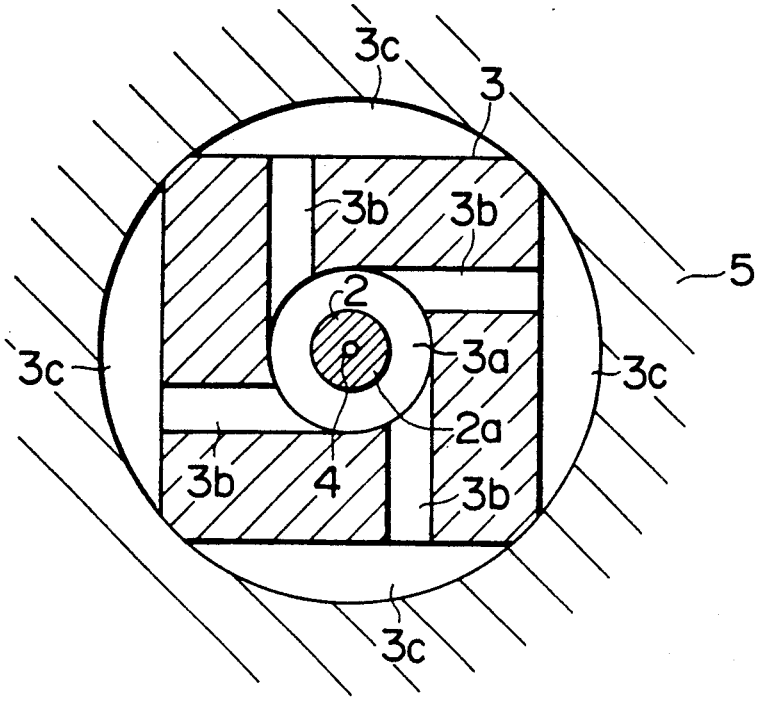
FIG. 13 is a section taken along the line XIII—XIII of FIG. 12 and viewed in the direction indicated by the arrows.

FIGS. 12 and 13 shows a fourth embodiment of the present invention. A fuel injection valve according to this embodiment is different from that shown in FIGS. 1 and 2 in that the fuel rotating element 3 is disposed upstream of the valve seat 2, and in that the fuel rotating chamber **3*a* is formed by the outer surface of a convex portion 2*a* and the inner surface of the fuel rotating element 3. Also, the yoke 5, the stopper 12, and the spacer 13 are partially notched to form a fuel flow passage 30 through which the fuel is introduced to the flow passages 3*c* of the fuel rotating element 3**.

The fuel injection valve according to the present embodiment has the same configuration as that of the fuel injection valve shown in FIG. 1 with the exception that the fuel rotating chamber **3*a* is positioned upstream of the valve seat 2**, and therefore has the same advantages.

Figure 14:
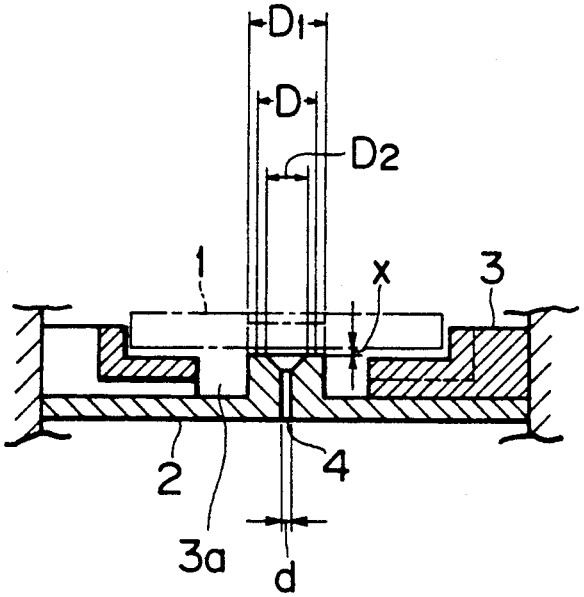
FIG. 14 explains the area of an opening in the fuel injection valve shown in FIG. 12.

FIG. 14 explains the sectional area of the flow passages in the fuel injection valve shown in FIG. 12. Where $A_1$ is the sectional area of the flow passages formed in the fuel rotating element 3, $A_2$ is the area of the opening formed in the plate valve 1, and $A_3$ is the sectional area of the injection hole, $A_1$, $A_2$ and $A_3$ has the following relation:

$A_1 > A_2 > A_3$.

$A_1$, $A_2$ and $A_3$ are respectively defined in the manner shown in Equations (1), (2) and (3) using the symbols in FIG. 14.

Figure 15:
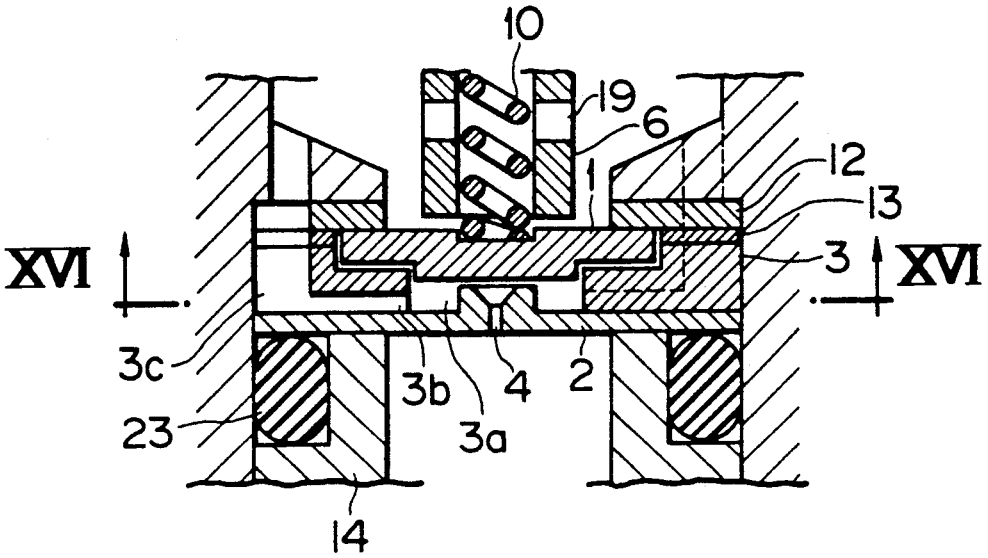
FIG. 15 is an enlarged view of the essential parts of a fuel injection valve, showing a modified example of the plate valve of FIG. 12
Figure 16:
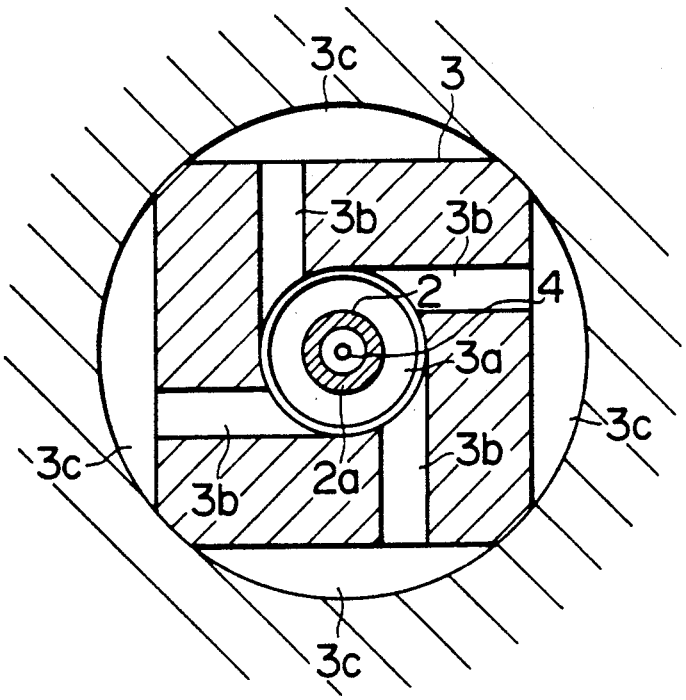
FIG. 16 is a section taken along the line XVI—XVI of FIG. 15 and viewed in the direction indicated by the arrows.

FIGS. 15 and 16 show a fifth embodiment of the present invention. In this embodiment, the plate valve 1 has a convex portion at a position where it covers the fuel rotating element 3. In this way, the degree of rotation of fuel in the fuel rotating chamber **3*a*** can be increased, and atomization of fuel can therefore be further accelerated.

Figure 17:
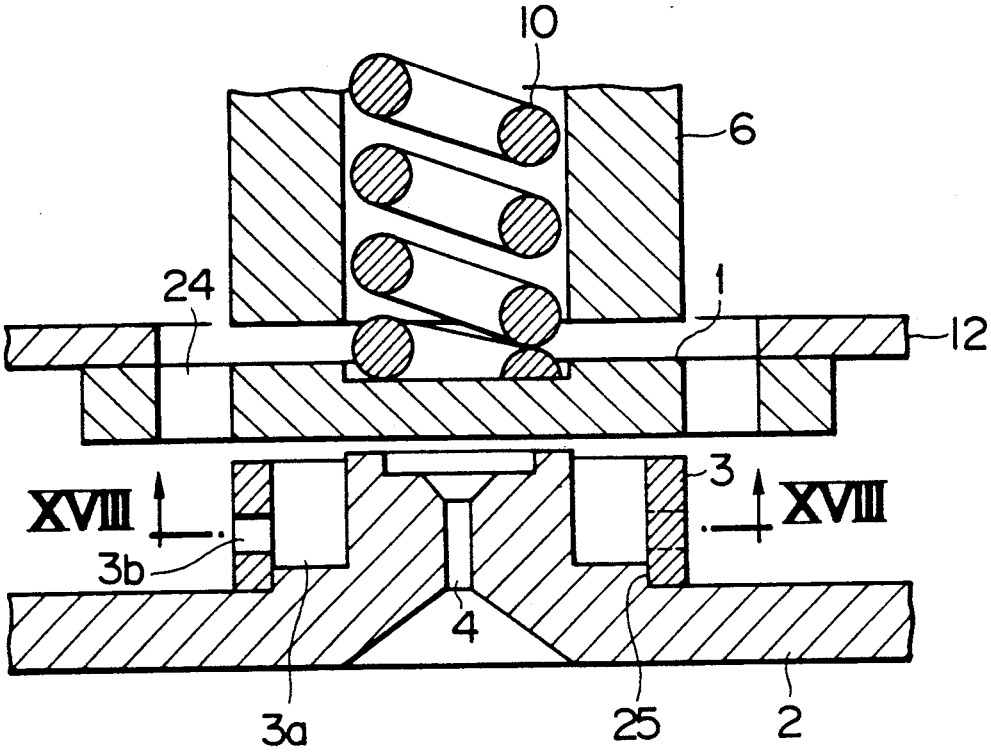
FIG. 17 is an enlarged view of the essential parts of a fuel injection valve, showing a modified example of the fuel rotating element of FIG. 12.
Figure 18:
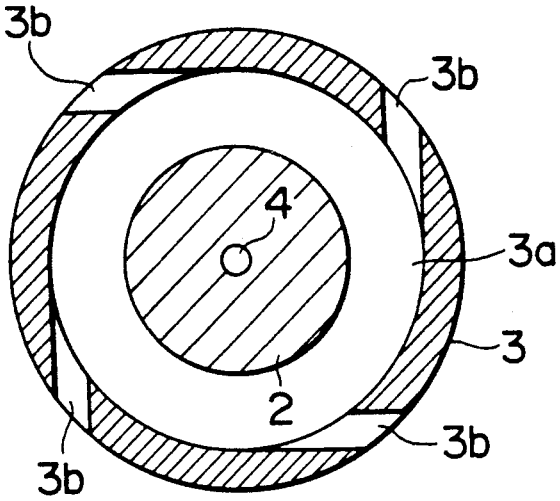
FIG. 18 is a section taken along the line XVIII—XVIII of FIG. 17 and viewed in the direction indicated by the arrows.

FIGS. 17 and 18 show a sixth embodiment of the present invention. Description of the portion of the fuel injection valve which is the same as that of FIGS. 12 and 13 is omitted. In this embodiment, the fuel rotating element 3 has a cylindrical form, and therefore has a receiving portion 25. The fuel rotating element 3 has a plurality of grooves 3*b* formed eccentrically in a cylindrical portion thereof. The receiving portion 25 forms the fuel rotating chamber 3*a*. The fuel injection valve arranged in this manner enables the size of the fuel rotating element to be reduced.

Figure 19:
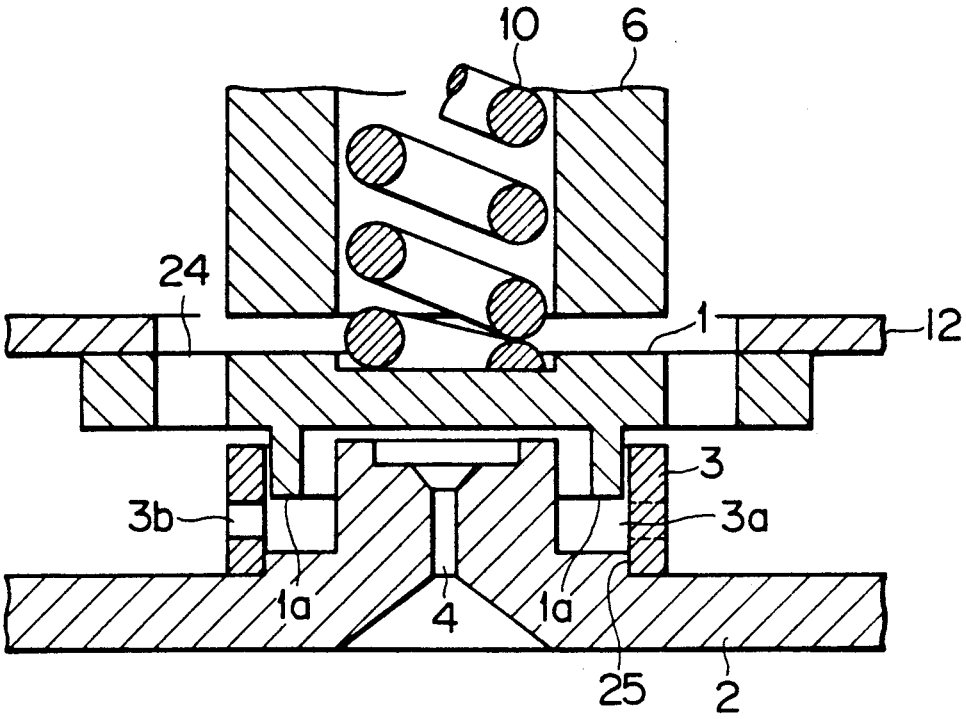
FIG. 19 is an enlarged view of the essential parts of a fuel injection valve, showing a modified example of the plate valve of FIG. 17.

FIG. 19 shows a seventh embodiment of the present invention. This embodiment differs from that shown in FIG. 17 in that the plate valve has a cylindrical protrusion 1*a*. The protrusion la allows the fuel rotating element 3 to guide the plate valve 1. Also, it increases the sealing effect of the fuel rotating chamber 3*a*. In consequence, inclination of the plate valve 1 in its radial direction, which would occur during the operation, can be prevented, and fuel atomization can be further accelerated.

In the fuel injection valve according to the present invention, which employs a light-weight plate valve serving as a movable valve, fuel atomization can be accelerated, and the diameter of fuel particles can thus be reduced. Furthermore, the cleaning effects of the injection hole are high, so any foreign matter is prevented from depositing on the injection hole. These features enhance the ease with which an engine can be started at a low temperature, and the response and the reliability of the engine is improved. Furthermore, provision of the atomized fuel dividing means downstream of the injection hole allows the cross-sectional form of atomized fuel to be selected arbitrarily. This in turns allows the fuel injection valve to be suitably employed in any of various types of engines.

Furthermore, simplification of the fuel flow passage in the fuel rotating element enables the production cost of the fuel rotating element to be decreased. The production cost of the fuel rotating element can be further decreased by employing sintering in the manufacture of the fuel rotating element.

FIG. 20 shows an engine controlling system on which a fuel injection valve according to the present invention is mounted.

In FIG. 20, an engine 100 is a known flame ignition type engine which employs gasoline as fuel. A suction system for the engine 100 includes an air cleaner 110, a throttle body 120, an intake manifold 130, and a fuel injection valve 140 according to the present invention. An exhaust system therefor includes an exhaust manifold 150, an oxygen sensor 160 for measuring the concentration of oxygen in an exhaust gas, a three way catalytic converter 170 for purifying the exhaust gas, and a muffler (not shown).

The throttle body 120 is comprised of an air flow sensor 180, a throttle valve 190, and a throttle sensor 200. The flow rate of air to be supplied to the engine 100 is measured by the throttle body 120 with a high degree of accuracy. The catalytic converter 170 purifies at a high rate any NOx, CO and HC contained in the exhaust gas emitted from the engine 100 which is operated near a theoretical air-fuel ratio.

The engine 100 has a combustion chamber 220 with an ignition plug 210 disposed in opposed relation, an intake hole 230 and an intake valve 240 for opening/closing the intake hole 230. A water temperature sensor 250 is provided on the side of the combustion chamber 220, and a rotation sensor 260 is disposed below the combustion chamber 220 for detecting the state in which a vehicle is driven. The engine control system also includes an igniter 270, a distributor 280, an exhaust gas temperature sensor 290, and an electronic control device 300 for controlling the above-described components. The arrows in FIG. 20 indicate I/O systems of the individual components.

The fuel injection valve 140 is mounted on the wall of the intake manifold 130 upstream of the intake valve 240. The fuel injection valve is capable of injecting fuel toward a valve body 240*a* of the intake valve 240.

In the gasoline engine, a predetermined amount of air is taken into the combustion chamber 220 from the suction system in a suction stroke.

Fuel is injected from the fuel injection valve 140 toward the valve body 240*a* in an amount corresponding to the amount of air supplied and in an excellent atomized state and with excellent response to the injection pressure. The injected fuel is mixed with air efficiently and uniformly. The thus-obtained air-fuel mixture enters the combustion chamber 220, where it is compressed in a compression stroke and is then ignited by the ignition plug 210 for combustion.

A combustion gas exhausted from the engine 100 is discharged into an atmosphere through the exhaust system.

As the state in which the engine 100 is operated is detected by the water temperature sensor 250 and the rotation sensor 260, air is supplied in an amount determined in accordance with the detected state. The amount of air supplied is adjusted by adjusting the opening of the throttle valve 190. The amount of air supplied is measured precisely by the air flow sensor 180. At that time, the electronic control device 300 generates a signal for driving the fuel injection valve 140 in response to the signal from the air flow sensor 180 or from the throttle sensor 200. The amount of fuel injected is determined by this signal.

An air-fuel mixture is introduced from the intake hole 230 of the engine 100 into the combustion chamber 220. In the combustion chamber 220, the air-fuel mixture is compressed in the compression stroke and the compressed mixture is then ignited by the ignition plug 210. The burning state of the air-fuel mixture is monitored by the oxygen sensor 160 provided at the gathering portion of the exhaust manifold 150. The electronic control device 300 corrects the amount of fuel injected from the fuel injection valve 140 in response to the signal output from the oxygen sensor 160, and thereby maintains a predetermined mixture ratio (air-fuel ratio). This allows the three way catalytic converter 170 for processing three components of NOx, CO, and HC of the exhaust gas to operate most efficiently.

What is claimed is:

1. An electromagnetic fuel injection valve for an internal combustion engine, comprising a valve seat disposed in a fuel passage and having an injection hole through which fuel is injected; a plate valve member constituted by a disk-like cylindrically-shaped movable member operating as a valve body and provided in said fuel passage upstream of said injection hole for controlling the amount of fuel injected through said injection hole; and a fuel rotating element provided upstream of said injection hole and downstream of said plate valve member for causing said fuel to flow in a circle as it enters said injection hole.

2. An electromagnetic fuel injection valve according to claim 1, wherein said plate valve member has an opening therein for the passage of fuel, the area of said opening in said plate valve member being smaller than the sectional area of the flow passage in said fuel rotating element and larger than the section area of said injection hole.

3. An electromagnetic fuel injection valve according to claim 1, wherein said valve seat has a recessed opening facing said plate valve member and communicating with said injection hole, and said fuel rotating element comprises a plate disposed within said recessed opening and having a plurality of radial groove-like channels which communicate with said injection hole and a plurality of radial passages which extend from said plate valve member to said radial channels.

4. An electromagnetic fuel injection valve according to claim 3, wherein said fuel rotating element is a sintered element.

5. An electromagnetic fuel injection valve according to claim 3, wherein said fuel rotating element has a hollow disposed in the surface of said plate which faces said injection opening, said hollow communicating with said radial channels and said injection opening so as to form a fuel rotating chamber.

6. An electromagnetic fuel injection valve according to claim 1, further including dividing means provided downstream of said injection hole for dividing fuel injected through said injection hole into a plurality of portions.

7. An electromagnetic fuel injection valve according to claim 6, wherein said dividing means has a cross-sectional form defined by at least two circular arcs.

8. An electromagnetic fuel injection valve according to claim 6, wherein said dividing means has a cross-sectional form consisting of at least two circles.

9. An electromagnetic fuel injection valve according to claim 1, wherein said valve seat is provided as a plate-like member having a centrally disposed projection extending toward said plate valve member for contact therewith and in which said injection hole is provided, and said fuel rotating element comprises a plate having a central bore through which said centrally disposed projection on said valve seat extends, said plate having channels including radial portions which communicate with said central bore to permit fuel to flow from upstream of said plate valve member to said central bore, so that fuel is rotated and supplied to said injection hole via said central bore when said plate valve member is out of contact with said centrally disposed projection.

10. An electromagnetic fuel injection valve according to claim 9, wherein said central bore in said fuel rotating element has a sufficient diameter to form a fuel rotating chamber.

11. An electromagnetic fuel injection valve according to claim 9, wherein said plate valve member has a cylindrical projection extending toward said valve seat for engaging with said centrally disposed projection to selectively obstruct the injection hole therein.

12. An electromagnetic fuel injection valve according to claim 9, wherein said plate valve member has an annular projection extending toward said valve seat for guiding axial movement of said plate valve member in such a way as to prevent tilting thereof.

13. An electromagnetic fuel injection valve for an internal combustion engine, comprising a valve seat disposed in a fuel passage and having an injection hole through which fuel is injected; and a plate valve member constituted by a disk-like cylindrically-shaped movable member operating as a valve body and provided in said fuel passage upstream of said injection hole for controlling the amount of fuel injection through said injection hole; wherein said injection hole has the smallest sectional area in said fuel passage, whereby the static flow rate of fuel flowing through said fuel passage is determined solely by said injection hole.

14. An electomagnetic fuel injection valve for an internal combustion engine, comprising a valve seat disposed in a fuel passage and having an injection hole through which fuel is injected; a plate valve member constituted by a disk-like cylindrically-shaped movable member operating as a valve body and provided in said fuel passage upstream of said injection hole for controlling an amount of fuel injected through said injection hole; a fuel rotating element provided upstream of said injection hole for causing said fuel to flow in a circle; and dividing means provided downstream of said injection hole for dividing fuel injected through said injection hole into a plurality of portions.

15. An electromagnetic fuel injection valve according to claim 14, wherein said dividing means has a cross-sectional form defined by at least two circular arcs.

16. An electromagnetic fuel injection valve according to claim 14, wherein said dividing means has a cross-sectional form consisting of at least two circles.

17. An electromagnetic fuel injection valve for an internal combustion engine, comprising:

a valve seat disposed in a fuel passage and having an injection hole through which fuel injected;

a plate valve member constituted by a disk-like cylindrically-shaped movable member operating as a valve body and provided in said fuel passage upstream of said injection hole for controlling the amount of fuel injected through said injection hole;

biasing means for resiliently biasing said plate valve member into contact with said valve seat so as to obstruct the flow of fuel to said injection hole;

a housing coupled to said valve seat and having an electromagnetic coil disposed therein for selectively generating a magnetic field which causes said plate valve member to move away from said valve seat against the force of said biasing means and allow fuel to flow to said injection hole; and fuel rotating means disposed between said plate valve member and said injection hole for causing fuel which passes said plate valve member to be rotated and flow in a circle as it enters and flows through said injection hole.

* * * * *